US010839761B2

(12) United States Patent
Aoki et al.

(10) Patent No.: US 10,839,761 B2
(45) Date of Patent: Nov. 17, 2020

(54) DISPLAY DEVICE AND DISPLAY DRIVER FOR IMPROVING RESPONSE TIME BY PREPARATORY WRITING OF A PREDETERMINED GRADATION

(71) Applicant: Japan Display Inc., Minato-ku (JP)

(72) Inventors: Yoshiro Aoki, Tokyo (JP); Toshiharu Matsushima, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 15/903,664

(22) Filed: Feb. 23, 2018

(65) Prior Publication Data

US 2018/0240424 A1 Aug. 23, 2018

(30) Foreign Application Priority Data

Feb. 23, 2017 (JP) ..... 2017-032078

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3677* (2013.01); *G09G 3/3688* (2013.01); *G09G 2300/0426* (2013.01); *G09G 2320/029* (2013.01); *G09G 2320/0252* (2013.01); *G09G 2320/0271* (2013.01); *G09G 2340/16* (2013.01)

(58) Field of Classification Search
CPC ..... G09G 3/3406–3426; G09G 3/3648; G09G 3/3666; G09G 3/3677; G09G 3/3688; G09G 2310/0221; G09G 2310/0245; G09G 2310/0248; G09G 2310/0251; G09G 2320/0252; G02F 1/1336
See application file for complete search history.

(56) References Cited

U.S. PATENT DOCUMENTS 7,030,848 B2 * 4/2006 Sato ..... G09G 3/342 345/94
7,136,040 B1 * 11/2006 Park ..... G02F 1/1345 345/100
9,135,873 B2 * 9/2015 Miyatake ..... G09G 3/3614
9,495,923 B2 * 11/2016 Shiomi ..... G09G 3/3611
(Continued)

FOREIGN PATENT DOCUMENTS

JP 2006-330311 12/2006

*Primary Examiner* — Gene W Lee
(74) *Attorney, Agent, or Firm* — Oblon, McClelland, Maier & Neustadt, L.L.P.

(57) ABSTRACT

According to one embodiment, a display driver configured to control a display operation of an active-matrix display device, wherein the display device includes a display area in which liquid crystal pixels are arranged in a matrix form, a plurality of scanning lines arranged along rows, a plurality of signal lines arranged along columns, a plurality of switching elements arranged in the vicinities of positions at which the scanning lines and the signal lines intersect each other, and a backlight, and the display driver controls preparatory write of writing a signal of a predetermined gradation to the liquid crystal pixels, thereafter controls sequential write of an image signal to the liquid crystal pixels, and at the time after an elapse of a predetermined time from the preparatory write, makes the backlight light up.

12 Claims, 14 Drawing Sheets

(56) References Cited

U.S. PATENT DOCUMENTS

| | | | | |
|---|---|---|---|---|
| 2002/0196220 | A1* | 12/2002 | Sato | G09G 3/342 345/87 |
| 2003/0098860 | A1* | 5/2003 | Nakamura | G09G 3/3648 345/211 |
| 2005/0248556 | A1* | 11/2005 | Yoshinaga | G02F 1/136286 345/204 |
| 2006/0033727 | A1* | 2/2006 | Hsu | G09G 3/3648 345/204 |
| 2007/0109254 | A1* | 5/2007 | Kang | G09G 3/342 345/103 |
| 2010/0295844 | A1* | 11/2010 | Hayashi | G09G 3/3666 345/214 |
| 2011/0141003 | A1* | 6/2011 | Kim | G09G 3/342 345/102 |
| 2016/0035304 | A1* | 2/2016 | Zheng | G02F 1/136286 345/211 |

* cited by examiner

| Liquid crystal response avg (unit: msec) | | Target level | | | | | | |
|---|---|---|---|---|---|---|---|---|
| | | 0 | 45 | 79 | 118 | 145 | 207 | 255 |
| Start level | 0 | | 4.1 | 4.7 | 4.7 | 5.3 | 4.6 | 3.3 |
| | 45 | 1.8 | | 3.6 | 4.3 | 4.6 | 4.2 | 3.2 |
| | 79 | 1.9 | 3.3 | | 3.9 | 4.1 | 4.2 | 3.2 |
| | 118 | 2.0 | 3.5 | 3.8 | | 3.6 | 3.6 | 3.1 |
| | 145 | 2.0 | 3.3 | 3.8 | 3.6 | | 3.6 | 2.9 |
| | 207 | 2.1 | 3.0 | 3.6 | 4.0 | 4.0 | | 2.9 |
| | 255 | 2.3 | 3.0 | 3.4 | 3.7 | 4.1 | 3.7 | |

| Liquid crystal response avg (unit: msec) | | Target level | | | | | | |
|---|---|---|---|---|---|---|---|---|
| | | 0 | 45 | 79 | 118 | 145 | 207 | 255 |
| Start level | 0 | | 4.1 | 4.7 | 4.7 | 5.3 | 4.6 | 3.3 |
| | 45 | 1.8 | | 3.6 | 4.3 | 4.6 | 4.2 | 3.2 |
| | 79 | 1.9 | 3.3 | | 3.9 | 4.1 | 4.2 | 3.2 |
| | 118 | 2.0 | 3.5 | 3.8 | | 3.6 | 3.6 | 3.1 |
| | 145 | 2.0 | 3.3 | 3.8 | 3.6 | | 3.6 | 2.9 |
| | 207 | 2.1 | 3.0 | 3.6 | 4.0 | 4.0 | | 2.9 |
| | 255 | 2.3 | 3.0 | 3.4 | 3.7 | 4.1 | 3.7 | |

FFS pixel

| Liquid crystal response avg (unit: msec) | | Target level | | | | | | |
|---|---|---|---|---|---|---|---|---|
| | | 0 | 45 | 79 | 118 | 145 | 207 | 255 |
| Start level | 0 | | 15.5 | 17.8 | 19.8 | 19.6 | 16.4 | 10.0 |
| | 45 | 5.8 | | 14.9 | 18.1 | 18.6 | 15.6 | 9.6 |
| | 79 | 7.0 | 11.5 | | 16.7 | 18.2 | 15.1 | 9.5 |
| | 118 | 7.3 | 10.5 | 13.1 | | 15.8 | 14.4 | 9.3 |
| | 145 | 7.4 | 9.7 | 12.5 | 14.3 | | 13.9 | 9.1 |
| | 207 | 7.8 | 11.5 | 10.8 | 13.0 | 13.3 | | 8.6 |
| | 255 | 8.7 | 11.6 | 10.3 | 11.8 | 12.6 | 11.9 | |

When the start gradation is 255, a significant improvement in the liquid crystal response time of about 60% can be expected

FIG. 8

Targeted intermediate gradation range

Max. 5.3 msec

| Liquid crystal response avg (unit: msec) | | Target level | | | | | | |
|---|---|---|---|---|---|---|---|---|
| | | 0 | 45 | 79 | 118 | 145 | 207 | 255 |
| Start level | 0 | | 4.1 | 4.7 | 4.7 | 5.3 | 4.6 | 3.3 |
| | 45 | 1.8 | | 3.6 | 4.3 | 4.6 | 4.2 | 3.2 |
| | 79 | 1.9 | 3.3 | | 3.9 | 4.1 | 4.2 | 3.2 |
| | 118 | 2.0 | 3.5 | 3.8 | | 3.6 | 3.6 | 3.1 |
| | 145 | 2.0 | 3.3 | 3.8 | 3.6 | | 3.6 | 2.9 |
| | 207 | 2.1 | 3.0 | 3.6 | 4.0 | 4.0 | | 2.9 |
| | 255 | 2.3 | 3.0 | 3.4 | 3.7 | 4.1 | 3.7 | |

Max. 3.8 msec

FIG. 14

| Liquid crystal response avg (unit: msec) | | Target level | | | | | | |
|---|---|---|---|---|---|---|---|---|
| | | 0 | 45 | 79 | 118 | 145 | 207 | 255 |
| Start level | 0 | | 4.1 | 4.7 | 4.7 | 5.3 | 4.6 | 3.3 |
| | 45 | 3.0 | | 3.6 | 4.3 | 4.6 | 4.2 | 3.2 |
| | 79 | 3.1 | 3.3 | | 3.9 | 4.1 | 4.2 | 3.2 |
| | 118 | 3.3 | 3.5 | 3.8 | | 3.6 | 3.6 | 3.1 |
| | 145 | 3.4 | 3.5 | 3.8 | 3.6 | | 3.6 | 2.9 |
| | 207 | 3.4 | 3.5 | 3.6 | 4.0 | 4.0 | | 2.9 |
| | 255 | 3.3 | 3.4 | 3.4 | 3.7 | 4.1 | 3.7 | |

F I G. 16

DISPLAY DEVICE AND DISPLAY DRIVER FOR IMPROVING RESPONSE TIME BY PREPARATORY WRITING OF A PREDETERMINED GRADATION

CROSS-REFERENCE TO RELATED APPLICATIONS

This application is based upon and claims the benefit of priority from Japanese Patent Application No. 2017-032078, filed Feb. 23, 2017, the entire contents of which are incorporated herein by reference.

FIELD

Embodiments described herein relate generally to a display driver and display device.

BACKGROUND

Liquid crystal display devices are thin in thickness, are light in weight, and are of low power consumption, and hence are used as displays of various types of apparatuses. Above all, an active-matrix liquid crystal display device in which a transistor is arranged for each pixel is now widespread as a display of various apparatuses such as a TV set, vehicle-mounted display such as a car navigation system and the like, mobile terminal, and the like such as a notebook-sized personal computer, tablet PC, portable telephone, and smartphone.

With development of application of the liquid display device in various fields in these days, higher-grade display performance has been required than ever before. Particularly, regarding the display response characteristics, that the liquid crystal device is less responsive than the self-luminous devices having no physical action part such as OLED and the like somewhat owing to the fact that the principle of operation of the liquid crystal device is dependent on the light shutter operation to be carried out by liquid crystal molecules which are the basis of the display element has been a disadvantage thereof.

On the other hand, in the current market, a new product form represented by Virtual Reality (VR) and Augmented Reality (AR) is now rapidly becoming widespread. Regarding a display device to be used for such a product, from necessity to eliminate the harmful influence such as an unpleasant sick symptom or the like at the time of use of VR to the utmost extent, a very high level is particularly required of the response characteristics among the display qualities. For this reason, application of the liquid crystal display device to the above-mentioned purpose has been in an unfavorable state as compared with the self-luminous devices such as the OLED and the like having excellent response characteristics.

In order to improve such a disadvantage, a method of supplying a voltage having an amplitude greater than an image signal actually used for display to each pixel as overdrive is proposed. On the other hand, in order to improve the visibility of display, a method of controlling the lighting operation of the backlight and shortening the lighting time of the backlight to thereby keep the backlight in the shutoff state during the response time of the liquid crystal and carry out control so that the response operation of the liquid crystal may not visually confirmed in real terms is also proposed.

However, in the method of using the overdrive, there has been a problem that it is difficult to uniformly adjust the voltage written to the pixels by overdrive in the plane in such a manner that the voltage is set to a desired voltage in accordance with the backlight lighting. Further, in the case where lighting of the backlight is controlled, with the improvement in definition, and with the increase in the requirement of higher responsivity, there has been a problem that in the pixels written in the latter half of the write operation, the possibility of the response operation of the liquid crystal being visually confirmed while the backlight is being lit becomes stronger.

BRIEF DESCRIPTION OF THE DRAWINGS

FIG. 8 is an exemplary view showing a relationship between the liquid crystal response of a display device of a variation of the first embodiment and initial voltage.

FIG. 14 is an exemplary view showing a relationship between the liquid crystal response and initial voltage to be used when the preparatory write voltage of the display device of the embodiment is selected.

FIG. 16 is an exemplary view showing a relationship between the liquid crystal response and initial voltage to be used when a preparatory write voltage not impairing the visibility of the display device of the embodiment is selected.

DETAILED DESCRIPTION

Figure 1:
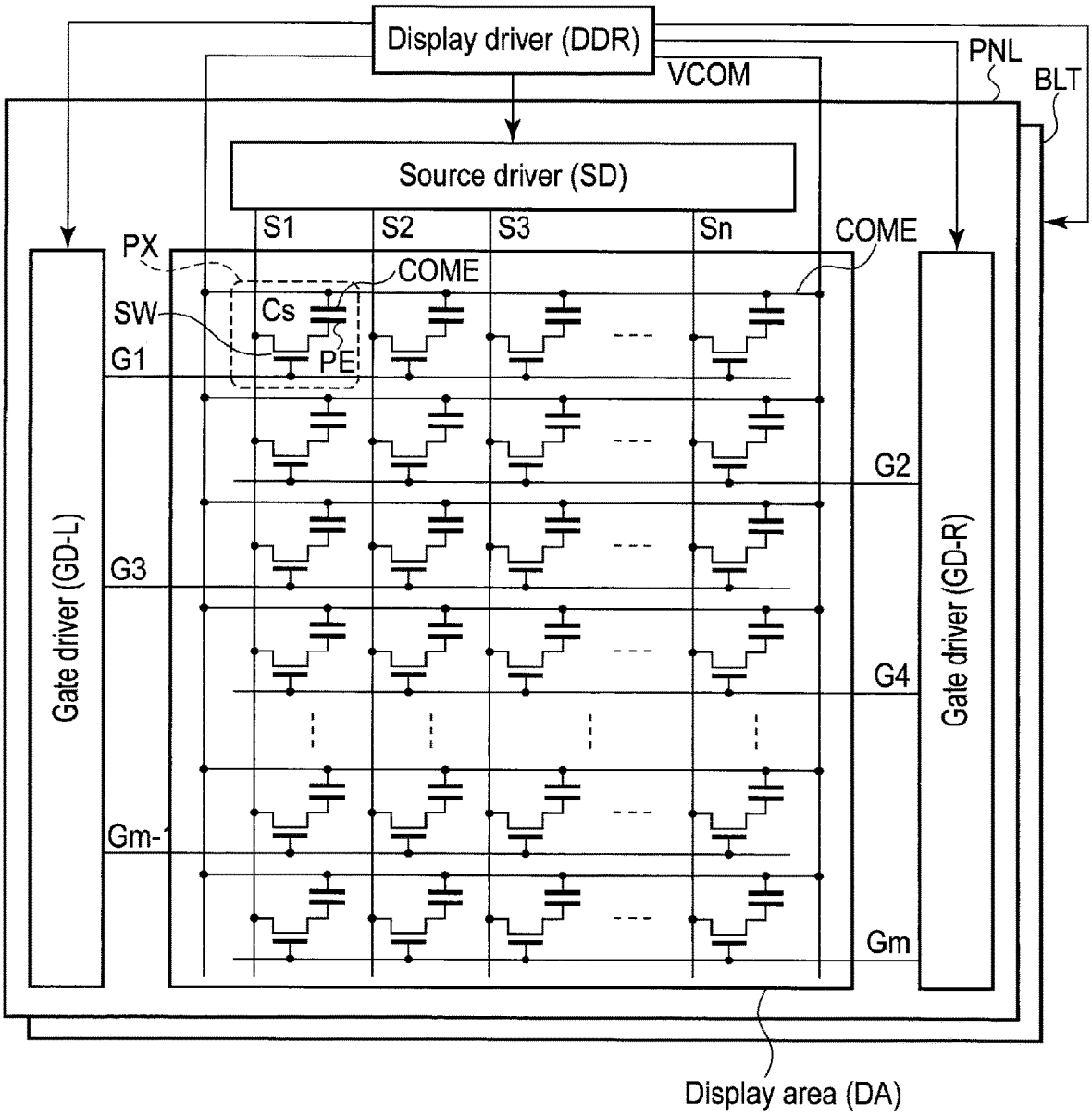
FIG. 1 is an exemplary view showing the schematic configuration of a display device of a first embodiment.

Various embodiments will be described hereinafter with reference to the accompanying drawings.

In general, according to one embodiment, a display driver configured to control a display operation of an active-matrix display device, wherein the display device includes a display area in which liquid crystal pixels are arranged in a matrix form, a plurality of scanning lines arranged along rows in which the liquid crystal pixels are arranged, a plurality of signal lines arranged along columns in which the liquid crystal pixels are arranged, a plurality of switching elements arranged in the vicinities of positions at which the scanning lines and the signal lines intersect each other, and a backlight configured to illuminate the display area, and the display driver controls preparatory write of writing a signal of a predetermined gradation to the liquid crystal pixels, thereafter controls sequential write of an image signal to the liquid crystal pixels, and at the time after an elapse of a predetermined time from the preparatory write, makes the backlight light up.

The disclosure is merely an example, and proper changes within the spirit of the invention, which are easily conceivable by a skilled person, are included in the scope of the invention as a matter of course. In addition, in some cases, in order to make the description clearer, the widths, thicknesses, shapes, etc., of the respective parts are schematically illustrated in the drawings, compared to the actual modes. However, the schematic illustration is merely an example, and adds no restrictions to the interpretation of the invention. Besides, in the specification and drawings, the same elements as those described in connection with preceding drawings are denoted by like reference numerals, and a detailed description thereof is omitted unless otherwise necessary.

Hereinafter, each embodiment will be described by taking a liquid crystal display device as an example of a display device.

First Embodiment

FIG. 1 is a view showing the schematic configuration of a display device DSP of a first embodiment.

The display device DSP is provided with a display panel PNL, and backlight BLT configured to illuminate the display panel PNL from a backside thereof. Further, in the display panel PNL, a display area DA including unit pixels PX arranged in a matrix form is provided.

As shown in FIG. 1, in the display area DA, scanning lines G (G1, G2, • • • ) extending along rows in which a plurality of unit pixels PX are arranged, signal lines S(S1, S2, • • • ) extending along columns in which a plurality of unit pixels PX are arranged, and switching elements SW arranged in the vicinities of positions at which the scanning lines G and signal lines S intersect each other are provided.

The switching element SW is provided with a thin film transistor (TFT). A gate electrode of the switching element SW is electrically connected to a corresponding scanning line G. A source electrode of the switching element SW is electrically connected to a corresponding signal line S. A drain electrode of the switching element SW is electrically connected to a corresponding pixel electrode PE (second electrode E2 to be described later).

Further, as the drive means for driving the plurality of unit pixels PX, gate drivers GD (left GD-L and right GD-R) and source driver SD are provided. The plurality of scanning lines G are electrically connected to output terminals of the gate drivers GD. The plurality of signal lines S are electrically connected to output terminals of the source driver SD.

The gate drivers GD and source driver SD are arranged in a peripheral area (frame) of the display area DA. The gate drivers GD apply in sequence an on-voltage to the plurality of scanning lines G to thereby supply the on-voltage to a gate electrode of a switching element SW electrically connected to the selected scanning line G. The part between the source electrode and drain electrode of the switching element SW to which the on-voltage has been supplied at the gate electrode of which is made conductive. The source driver SD supplies a corresponding output signal to each of the plurality of signal lines S. The signal supplied to the signal line S is applied to a corresponding pixel electrode PE through the switching element SW in which the part between the source electrode and drain electrode has been made conductive.

Operations of the gate drivers GD and source driver SD are controlled by a display driver DDR arranged outside the display panel PNL. In addition, the display driver DDR supplies a common voltage Vcom to common electrodes (first electrodes E1 to be described later). Furthermore, the display driver DDR controls an operation of the backlight BLT.

Figure 2:
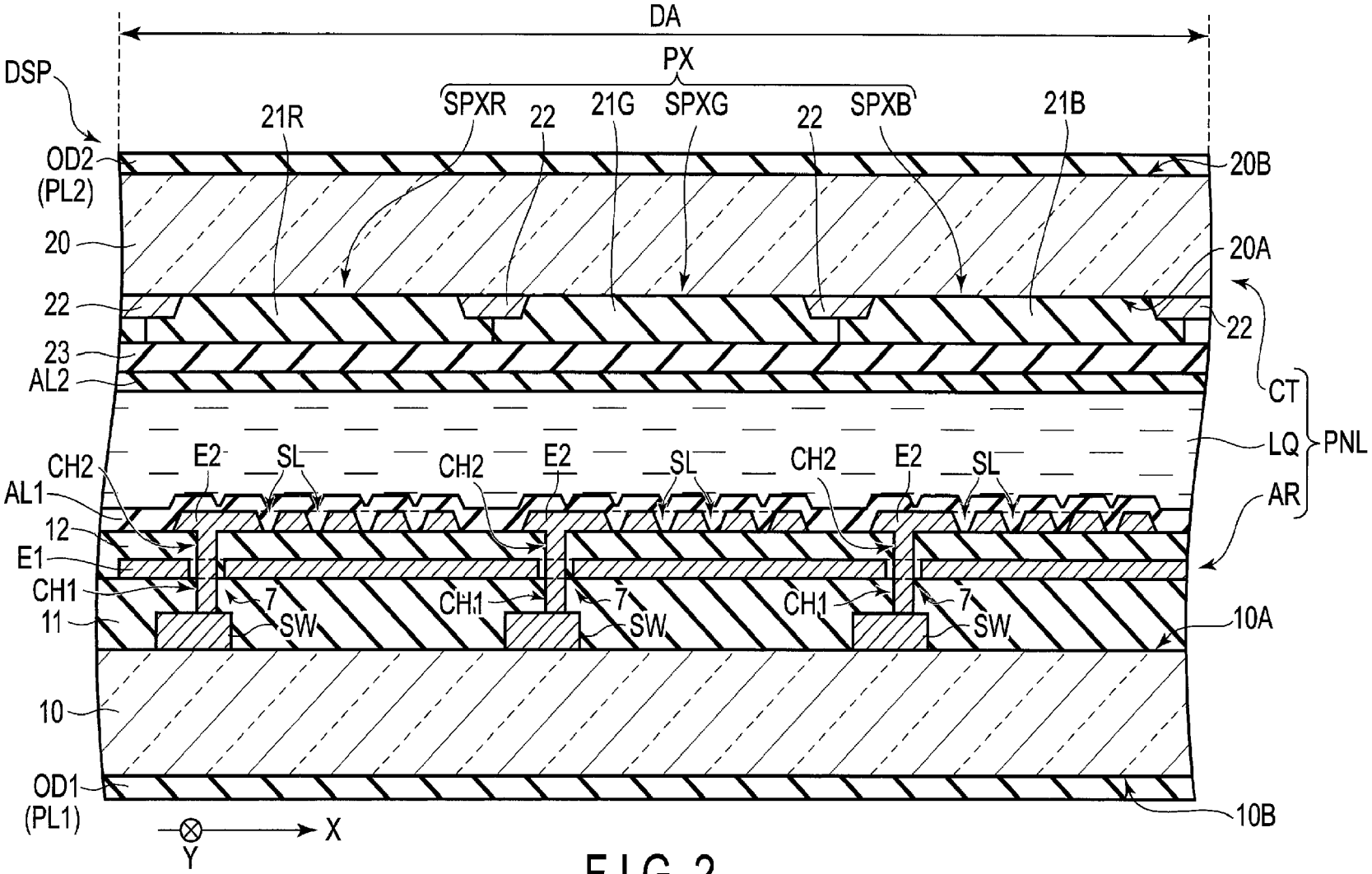
FIG. 2 is an exemplary cross-sectional view showing the structure of the display device of the first embodiment in more detail.

FIG. 2 is a cross-sectional view showing the structure of the display device DSP of the first embodiment in more detail.

As described above, the display panel PNL is provided with a large-number of unit pixels PX in the display area DA thereof configured to display an image. The unit pixel PX is a minimum unit constituting a color image to be displayed on the display area DA, and includes a plurality of sub-pixels SPX corresponding to different colors. In the example of FIG. 2, the structure of a unit pixel PX in which sub-pixels SPXR, SPXG, and SPXB corresponding to red, green, and blue are arranged in a first direction X is shown. It should be noted that the unit pixel PX may include, for example, a sub-pixel SPX corresponding to white in addition to the sub-pixels SPXR, SPXG, and SPXB.

The display panel PNL is provided with an array substrate AR, counter-substrate CT arranged in opposition to the array substrate AR, and liquid crystal layer LQ sealed in the part between the array substrate AR and counter substrate CT. In this embodiment, dielectric constant anisotropy of liquid crystal molecules contained in the liquid crystal layer LQ is positive.

The array substrate AR is provided with a first insulating substrate 10 such as a glass substrate, resin substrate, and the like having optical transparency. The first insulating substrate 10 includes a first principal surface 10A on the side opposed to the counter substrate CT, and second principal surface 10B on the opposite side of the first principal surface 10. Furthermore, the array substrate AR is provided with, on the first principal surface 10A side of the first insulating substrate 10, switching elements SW, first electrode E1 (lower electrode), second electrode E2 (upper electrode), first insulating layer 11, second insulating layer 12, and first alignment film AL1.

The switching elements SW are each arranged for the sub-pixels SPX. The switching elements SW are provided on the first principal surface 10A of the first insulating substrate 10, and are covered with the first insulating layer 11. The first electrode E1 is formed on the first insulating layer 11.

In the example of FIG. 2, the first electrode E1 is provided in such a manner that the electrode E1 is common to all the sub-pixels SPXR, SPXG, and SPXB, and each of the second electrodes E2 is provided for each of the sub-pixels SPXR, SPXG, and SPXB on a one-to-one basis. Further, the first electrode E1 has an opening part 7 at each of positions opposed to the second electrodes E2 of the sub-pixels SPXR, SPXG, and SPXB.

The first electrode E1 is covered with the second insulating layer 12. The second electrodes E2 are formed on the second insulating layer 12, and are opposed to the first electrode E1. In the example of FIG. 2, each of the second electrodes E2 includes a plurality of slits SL. Each of the second electrodes E2 is electrically connected to the switching element SW of each of the sub-pixels SPXR, SPXG, and SPXB through each of the opening parts 7, each of contact holes CH1 provided in the first insulating layer 11, and each of contact holes CH2 provided in the second insulating layer 12.

The first electrode E1 has the opening part 7 at each of the positions corresponding to the contact holes CH1 and CH2. The first electrode E1 has a continuous shape without slits or the like except these opening parts 7.

In this embodiment, the first electrode E1 functions as a common electrode to which a common voltage is supplied, and each of the second electrodes E2 functions as a pixel electrode to which a voltage is selectively supplied for each sub-pixel SPX. The first electrode E1 and second electrodes E2 are formed of a transparent electrical conducting material such as Indium Tin Oxide (ITO), Indium Zinc Oxide (IZO), and the like.

The first alignment film AL1 covers the second electrodes E2, and is in contact with the liquid crystal layer LQ. The first alignment film AL1 has already been subjected to alignment treatment such as rubbing treatment, photo-alignment treatment or the like.

On the other hand, the counter-substrate CT is provided with a second insulating substrate 20 such as a glass substrate, resin substrate and the like having optical transparency. The second insulating substrate 20 includes a first principal surface 20A on the side opposed to the array substrate AR, and second principal surface 20B on the opposite side of the first principal surface 20A. Furthermore, the counter-substrate CT is provided with, on the first principal surface 20A side of the second insulating substrate 20, color filters 21R, 21G, and 21B, black matrix 22, overcoat layer 23, and second alignment film AL2.

The color filter 21R is formed of, for example, a red-colored resin material, and is arranged at the red sub-pixel SPXR. The color filter 21G is formed of, for example, a green-colored resin material, and is arranged at the green sub-pixel SPXG. The color filter 21B is formed of, for example, a blue-colored resin material, and is arranged at the blue sub-pixel SPXB.

The black matrix 22 defines the sub-pixels SPXR, SPXG, and SPXB. The borders between the color filters 21R, 21G, and 21B coincide with the black matrix 22. The overcoat layer 23 covers the color filters 21R, 21G, and 21B, and flattens the surfaces of the color filters 21R, 21G, and 21B.

The second alignment film AL2 covers the overcoat layer 23, and is in contact with the liquid crystal layer LQ. The second alignment film AL2 has already been subjected to alignment treatment such as rubbing treatment, photo-alignment treatment or the like as in the case of the first alignment film AL1.

On the outer surface of the array substrate AR, i.e., on the second principal surface 10B of the first insulating substrate 10, a first optical element OD1 including a first polarizer PL1 is arranged. Further, on the outer surface of the counter-substrate CT, i.e., on the second principal surface 20B of the second insulating substrate 20, a second optical element OD2 including a second polarizer PL2 is arranged. A first polarizing axis (or first absorption axis) of the first polarizer PL1 and second polarizing axis (or second absorption axis) of the second polarizer PL2 are in a cross-Nicol positional relationship in which the axes are perpendicular to each other.

The display device DSP configured as described above selectively passes therethrough light incident on the first optical element OD1 side for each sub-pixel SPX to thereby display an image on the display area DA.

Figure 3:
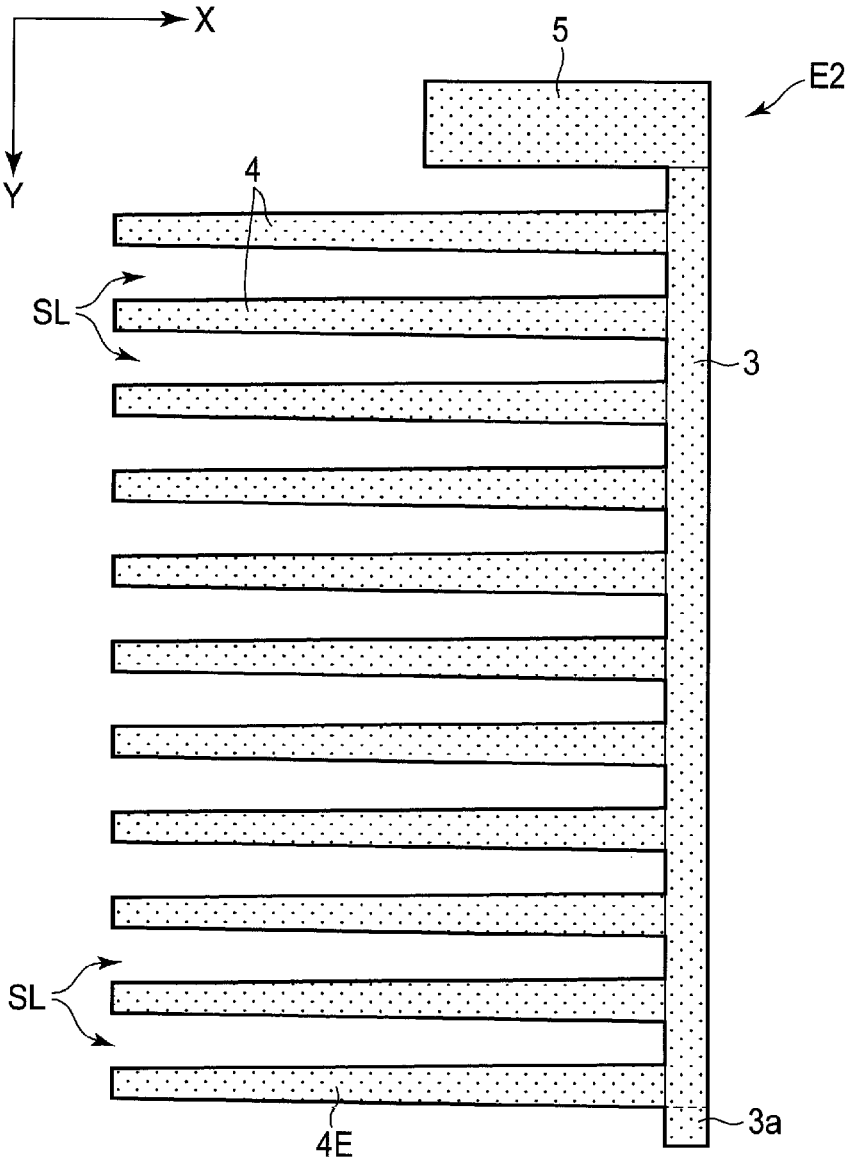
FIG. 3 is an exemplary view schematically showing an example of a shape applicable to a second electrode shown in FIG. 2.

FIG. 3 is a view schematically showing an example of a shape applicable to the second electrode E2 shown in FIG. 2. The second electrode E2 shown in FIG. 3 includes a connecting section 3 extending in the second direction Y intersecting the first direction X, a plurality of comb-like electrodes 4 extending from one side face part of the connecting section 3, and contact section 5 provided at one end part of the connecting section 3. In the example of FIG. 3, the second direction Y is the direction perpendicular to the first direction X.

The comb-like electrodes 4 each extend in the first direction X, and are arranged at regular intervals in the second direction Y. In the example of FIG. 3, although the com-like electrodes 4 each of which has a trapezoidal shape tapering off toward the tip are shown, the comb-like electrodes may have other shapes such as rectangular shapes. The spaces between adjacent comb-like electrodes 4 correspond to the above-mentioned slits SL. These slits SL extend in the first direction X as in the case of the comb-like electrodes 4. The connecting section 3 includes a protruding section 3*a* protruding in the second direction Y from the root of the comb-like electrode 4E arranged at the farthermost end (lower end in FIG. 3) in the second direction Y among the plurality of comb-like electrodes 4.

The first alignment film AL1 shown in FIG. 2 has already been subjected to alignment treatment in the alignment treatment direction AD parallel to the first direction X. On the other hand, the second alignment film AL2 has been subjected to the alignment treatment in the alignment treatment direction AD or in the direction opposite to the alignment treatment direction AD. That is, in the liquid crystal display device DSP according to this embodiment, the extension direction of the comb-like electrodes 4 and slits SL, and alignment treatment direction AD (or initial alignment direction of liquid crystal molecules) substantially coincide with each other.

As described above, the first electrode E1 and second electrodes E2 are opposed to each other through the second insulating layer 12, comb-like electrodes 4 are provided in each of the second electrodes E2 positioned on the liquid crystal layer LQ side, and the extension direction of the comb-like electrodes 4 and slits SL, and alignment treatment direction AD are made to coincide with each other, whereby it is possible to realize a high-speed lateral electric field mode which is different from a general FFS mode, and in which the response speed is higher.

Subsequently, the contents of an image display defect in the conventional liquid crystal drive method will be described below.

Figures 4, 5:
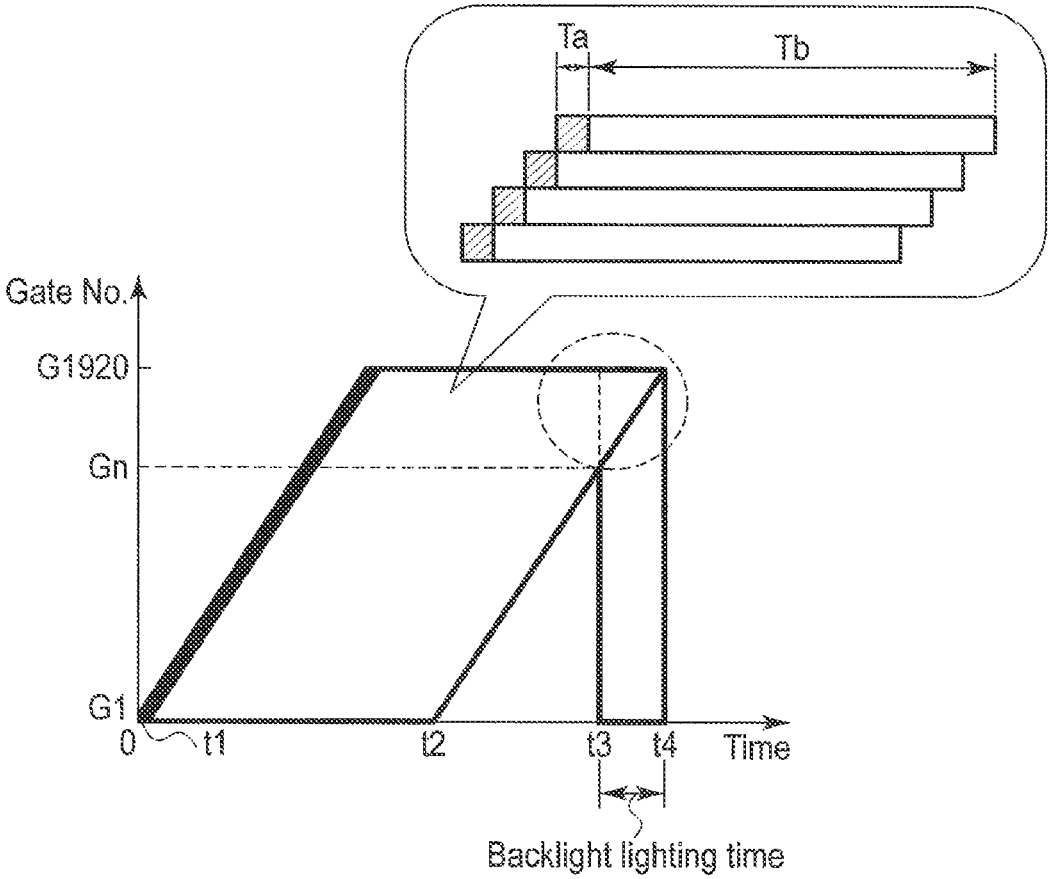
FIG. 4 is an exemplary view showing a relationship between the liquid crystal response examined prior to the examination of the display device of the first embodiment and initial voltage.
FIG. 5 is an exemplary view showing an example of the liquid crystal response examined prior to the examination of the display device of the first embodiment.

FIG. 4 is a view showing a relationship between the liquid crystal response examined prior to the examination of the display device of the first embodiment and initial voltage.

In the table shown in FIG. 4, the length of time (response time) needed to make the gradation (start gradation) shown at the start level change to the gradation (attainment gradation) shown at the target level after application of a voltage to the liquid crystal is shown. It should be noted that the values shown in this table are values obtained by measuring the response speed of the liquid crystal.

By referring to this table, it can be seen that particularly the response time necessary for the gradation to reach the intermediate gradation is long. For example, when the start gradation is 0 (black), the response time of the case where the attainment gradation is in the range from 118 to 145 (intermediate gradations) is greater than the response time of the case where the attainment gradation is 255 (white). The same applies to other start gradations (45 to 255). For this reason, when design of the drive system is carried out by using the normally employed response time of black (0) to white (255) to black (0) as the response time of the liquid crystal, the response time becomes longer than the designed value, whereby there is a possibility of the image quality of the moving image display being lowered.

FIG. 5 is a view showing an example of the liquid crystal response examined prior to the examination of the display device DSP of the first embodiment.

The axis of ordinate of the coordinates shown in FIG. 5 indicates the number of rows of the unit pixels PX in the display area DA. That is, the axis of ordinate indicates the numbers of scanning lines G. The axis of abscissa of the coordinates shown in FIG. 5 indicates the time of one frame.

A scanning line G1 on the X-axis of the coordinates will be described below. At time t1, a gate signal output from the scanning line G1 is turned on. In the period Ta during which the gate signal is on, write of an image signal is carried out. At the point in time at which the period Ta terminates, although the pixel electrode PE is set to a potential corresponding to the image signal, the liquid crystal has not yet completed a response thereof. The period Tb from the time t1 to time t2 is a period (transition period) necessary for the liquid crystal to complete the response.

At time t3, the backlight BLT starts lighting and, at time t4, the backlight BLT goes out. The time t4 corresponds to one frame period. Accordingly, in the unit pixel PX driven by the scanning line G1, the backlight BLT goes on after the liquid crystal completes the response, and hence a desired gradation is displayed.

Although the above drive operation is carried out in sequence for the scanning lines G1, G2, • • • G1920, in the liquid crystal driven by the scanning lines Gn to G1920, the backlight BLT has gone on before the liquid crystal completes the response. There is a possibility of such a phenomenon occurring, for example, when the design of a drive system is carried out by using the normally employed response time of black to white to black, if the response time for reaching the intermediate gradation is longer than the response time used in the design. Such a defect becomes obvious when a high level is required of the response characteristics, and the frame period is shortened.

The case shown in FIG. 5 can be permitted for still image display, but is not suitable for moving image display because the response state (state where the transmittance varies) of the liquid crystal is visually confirmed while the backlight is lighting. On the other hand, although it is conceivable that the backlight lighting start time is delayed in order that such a state may not occur, the backlight lighting time is made shorter, and hence the above measure results in an increase in the power consumption due to an increase in luminance.

Figures 6, 7:
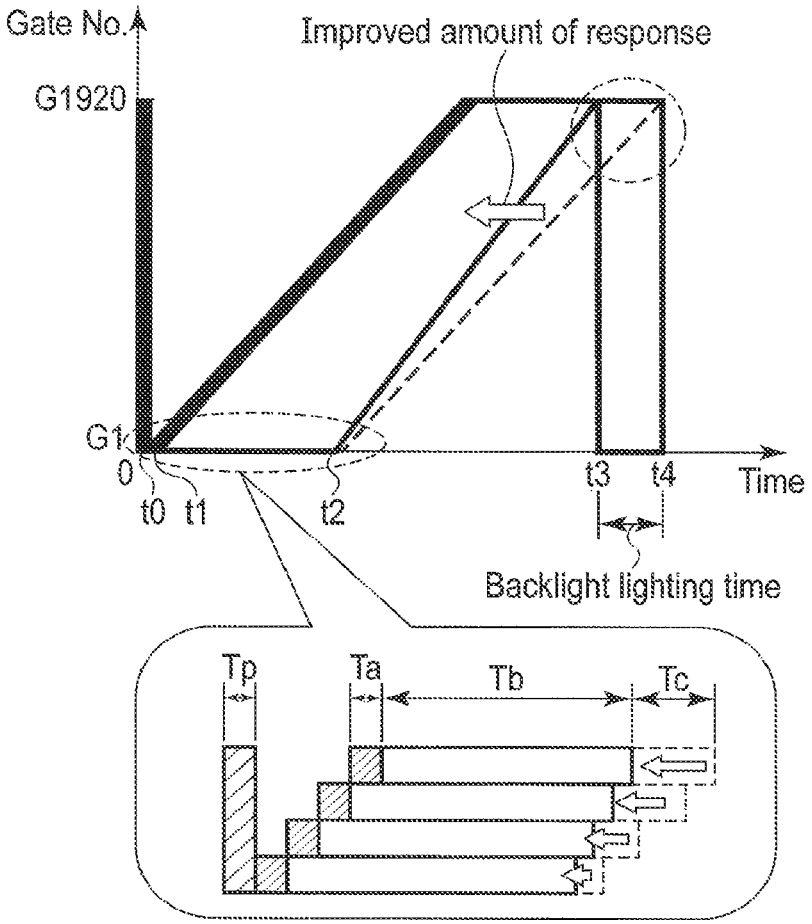
FIG. 6 is an exemplary view showing a relationship between the liquid crystal response of the display device of the first embodiment and initial voltage.
FIG. 7 is an exemplary view showing an example of the liquid crystal response of the display device of the first embodiment.

FIG. 6 is a view showing a relationship between the liquid crystal response of the display device DSP of the first embodiment and initial voltage.

By referring to this table, it can be seen that it is possible to largely improve the liquid crystal response time which has particularly been a problem in the conventional drive when the intermediate gradation is made the start gradation. Particularly, when the gradation 145 is made the start gradation, the liquid crystal response time is improved by about 20 to 25%.

FIG. 7 is a view showing an example of the liquid crystal response of the display device DSP of the first embodiment.

The axis of ordinate of the coordinates shown in FIG. 7 indicates the number of rows of the unit pixels PX in the display area DA. That is, the axis of ordinate indicates the numbers of scanning lines G. The axis of abscissa of the coordinates shown in FIG. 7 indicates the time of one frame.

At time t0, an image signal of the intermediate gradation (=gradation 145) is set to all the signal lines S, and thereafter, gate signals of all the scanning lines G1 to G1920 are turned on. In the period Tp during which all the gate signals are kept on, write (preparatory write) of the image signal of the intermediate gradation is carried out. After an elapse of the period Tp, the gate signals of all the scanning lines G1 to G1920 are turned off, and then a sequential write operation of the image signal is carried out.

The scanning line G1 on the X-axis of the coordinates will be described below. At time t1, the gate signal output from the scanning line G1 is turned on. In the period Ta during which the gate signal is kept on, write of the image signal is carried out. At a point in time at which the period Ta is terminated, although the pixel electrode PE is set to a potential corresponding to the image signal, the liquid crystal has not yet completed the response thereof. The period Tb from the time t1 to time t2 is a period (transition period) necessary for the liquid crystal to complete the response.

At time t3, the backlight BLT starts lighting and, at time t4, the backlight BLT goes out. Accordingly, in the unit pixel PX driven by the scanning line G1, the backlight BLT goes on after the liquid crystal completes the response, and hence a desired gradation is displayed.

The above drive operation is carried out in sequence for the scanning lines G1, G2, • • • G1920, and in each of all the liquid crystals driven by the scanning lines Gn to G1920, the response time has become shorter by the preparatory write, whereby the response to the desired gradation is completed before the time t3 at which the backlight ELT goes on. It should be noted that the dotted line starting from the time t2 in FIG. 7 indicates the time at which the liquid crystal in the conventional driving method shown in FIG. 5 completes the response, and the solid line stating from the time t2 indicates the time at which the liquid crystal in the driving method of the first embodiment completes the response to the desired gradation.

Here, in the pixel driven by the scanning line G, although after the image signal of the intermediate gradation is written by the preparatory write, write of the regular image signal is carried out, the later the drive order of a pixel to be driven by the scanning line G, the more stabilized the pixel is owing to convergence of changes in alignment of the liquid crystal molecules resulting from the preparatory write. That is, in a pixel the drive order of which is later than other pixels, the transmittance (gradation) of the liquid crystal has a value closer to the predetermined transmittance than the other pixels by the preparatory write, and hence improvement in the liquid crystal response time has been achieved. As shown in FIG. 7, the period (transition period) Tb necessary for the liquid crystal to complete the response has a value shorter than the conventional system in which preparatory write is not carried out by an amount corresponding to the response improvement period Tc resulting from the preparatory write.

Next, an operation of the display device DSP configured to realize the above-mentioned function will be described below with reference to FIG. 1.

In the preparatory write operation, the display driver DDR outputs a gradation voltage for preparatory write to the source driver SD. The source driver SD outputs the gradation voltage for preparatory write to all the signal lines S. The gradation voltage for preparatory write to be output may have a value set in advance from outside (not shown) or may have a value calculated by the display driver DDR by using, for example, the table shown in FIG. 4. A method of calculating an appropriate gradation voltage for preparatory write will be described later in detail.

Next, the display driver DDR outputs a signal configured to carry out control in such a manner that gate signals of all the gate lines G are turned on to the gate driver GD. For example, the signal is output to a circuit (not shown) incorporated in the gate driver GD, and configured to turn on gate signals of all the gate lines G. Further, after an elapse of a predetermined time (Tp), the display driver DDR outputs a signal configured to carry out control in such a manner that the gate signals of all the gate lines G are turned off to the gate driver GD.

Subsequently, the display driver DDR carries out control in such a manner that an image display operation is carried out. In the image display operation, the display driver DDR outputs a start signal and vertical synchronization signal to the gate driver GD, and outputs an image signal and horizontal synchronization signal to the source driver SD to thereby sequentially make the unit pixel PX of each row retain the image signal. Then, after making all the unit pixels PX retain the image signal, the display driver DDR turns on the backlight BLT after an elapse of a predetermined time (t3) from the start of the preparatory write operation, and turns off the backlight BLT after an elapse of a predetermined time (t4).

It should be noted that the time (one frame period) from the start of the preparatory write operation to turning off of the backlight BLT is time shorter than before, the time being controlled by the display driver DDR. The predetermined time (t3 or t4) controlled by the display driver DDR may have a value set in advance from outside (not shown) or may have a value calculated by the display driver DDR by using, for example, the table shown in FIG. 4.

Variation of First Embodiment

In the first embodiment, although the gradation for carrying out the preparatory write is made the intermediate gradation, the gradation for the preparatory write is not limited to the intermediate gradation, and an appropriate gradation can be selected according to the display mode, and type of the pixel.

FIG. 8 is a view showing a relationship between the liquid crystal response of a display device DSP of a variation of the first embodiment and initial voltage. In FIG. 8, the response of a liquid crystal of the Fringe Field Switching (FFS) mode in which the pixel electrode PE and common electrode are arranged in layers different from each other, and alignment of the liquid crystal molecules is controlled by utilizing a fringe electric field occurring between these electrodes is shown.

As in the case of the liquid crystal response characteristics shown in FIG. 6, when the start gradation is 0 (black), the response time of the case where the attainment gradation is 79 to 145 (intermediate gradation) is longer than the response time of the case where the attainment gradation is 255 (white). However, in the liquid crystal response characteristics shown in FIG. 8, when the start gradation is 255 (white), it can be seen that a significant improvement in the liquid crystal response time of about 60% can be expected.

Accordingly, it is not always the best choice to employ the intermediate gradation at all times as the start gradation. As described above, regarding what value should be determined as the start gradation, an appropriate value is determined according to the structure of the pixel, material to be used, and the like. However, when a high gradation is selected as the start gradation for preparatory write, there is a possibility of a case where the liquid crystal does not respond to the state corresponding to the normal image signal before the timing at which the backlight BLT goes on occurring. For example, when black is to be displayed on the whole screen, there is a case where a phenomenon of poor visibility in which a sufficiently black screen is not displayed is conspicuously recognized. A method of coping with such a case will be descried later in detail.

Second Embodiment

A second embodiment differs from the first embodiment in the signal writing method for image display. Parts identical to or similar to the first embodiment are denoted by reference symbols identical to the first embodiment, and their detailed descriptions are omitted.

Figure 9:
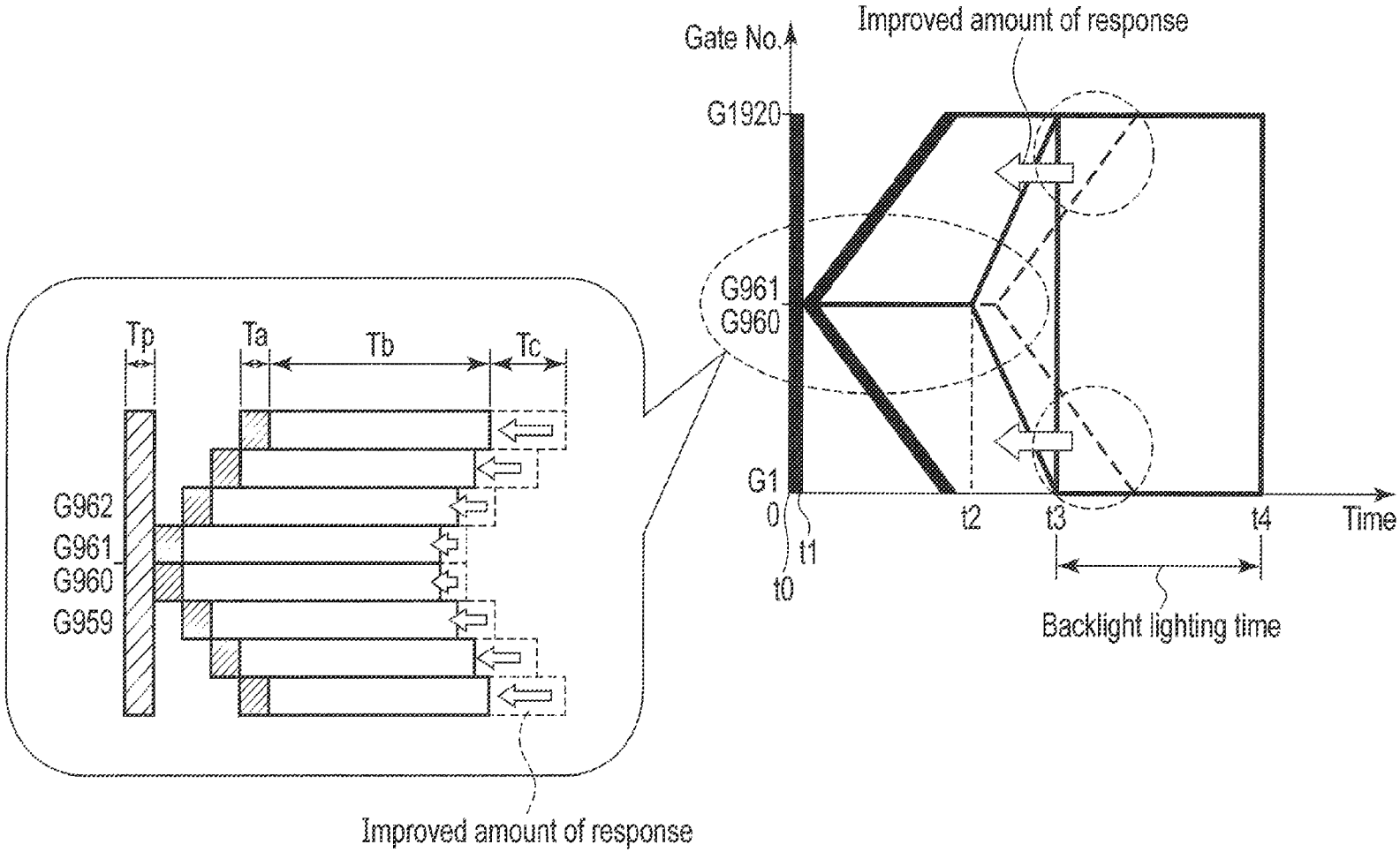
FIG. 9 is an exemplary view showing an example of the liquid crystal response of a display device of a second embodiment.

FIG. 9 is a view showing an example of the liquid crystal response of a display device DSP of the second embodiment.

The axis of ordinate of the coordinates shown in FIG. 9 indicates the number of rows of unit pixels PX in the display area DA. That is, the axis of ordinate indicates the numbers of the scanning lines G. The axis of abscissa of the coordinates shown in FIG. 9 indicates the time of one frame.

At time t0, an image signal of the intermediate gradation (=gradation 145) is set to all the signal lines S and, thereafter, gate signals of all the scanning lines G1 to G1920 are turned on. In the period Tp during which all the gate signals are kept on, write (preparatory write) of an image signal of the intermediate gradation is carried out. After an elapse of the period Tp, the gate signals of all the scanning lines G1 to G1920 are turned off.

In the second embodiment, the display area DA is divided into two upper and lower areas and, in the two divided areas, display operations are carried out simultaneously (concurrently) (upper/lower dual-partitioning scan).

At time t1, gate signals output from the scanning line G960 and scanning line G961 are turned on. In the period Ta during which the gate signals are kept on, write of the image signal is carried out. At a point in time at which the period Ta is terminated, although the corresponding pixel electrode PE is set to a potential corresponding to the image signal, the liquid crystal has not yet completed the response. The period Tb from the time t1 to time t2 is a period (transition period) necessary for the liquid crystals connected to the scanning lines G960 and G961 to complete the responses. At time t3, the backlight BLT starts lighting and, at time t4, the backlight BLT goes out.

The drive operation started from the scanning line G960 is carried out for G960, G959, • • • G1 downwardly from the center of the screen. The drive operation started from the scanning line G961 is carried out for G960, G961, • • • G1920 upwardly from the center of the screen. In each of the liquid crystals driven by all the scanning lines G1 to G1920, the response time has become shorter by the preparatory write, and hence the response to the desired gradation is completed before the time t3 at which the backlight BLT goes on.

According to the second embodiment, by combining the preparatory write and upper/lower dual-partitioning scan with each other, it is possible to increase the lighting time of the backlight BLT, and hence it is possible to reduce the power consumption. Further, it is possible to make the one frame period shorter than the first embodiment, and hence it is possible to enhance the response performance.

Next, an operation of the display device DSP configured to realize the above-mentioned function of the second embodiment will be described below with reference to FIG. 1.

The preparatory write operation is identical to the first embodiment, and hence a description thereof is omitted. Further, the lighting operation of the backlight BLT is identical to the first embodiment, and hence a description thereof is omitted.

In the image display operation, the display driver DDR outputs a start signal and vertical synchronization signal to the gate driver GD. The gate driver GD is provided with a circuit (not shown) configured to output a gate signal to the upper half part of the screen, and circuit (not shown) configured to output a gate signal to the lower half part of the screen. The source driver SD includes, unlike the first embodiment, source lines S configured to output an image signal to the upper half part of the screen, and source lines S configured to output an image signal to the lower half part of the screen.

The display driver DDR outputs a horizontal synchronization signal, image signal for the upper half part of the screen, and image signal for the lower half part of the screen to the source driver SD. Then, the display driver DDR sequentially makes the unit pixels PX retain the image signal upwardly and downwardly from the center of the screen.

Third Embodiment

In a third embodiment, the signal writing method for image display differs from the first embodiment. Parts identical to or similar to the first embodiment are denoted by reference symbols identical to the first embodiment, and their detailed descriptions are omitted.

Figure 10:
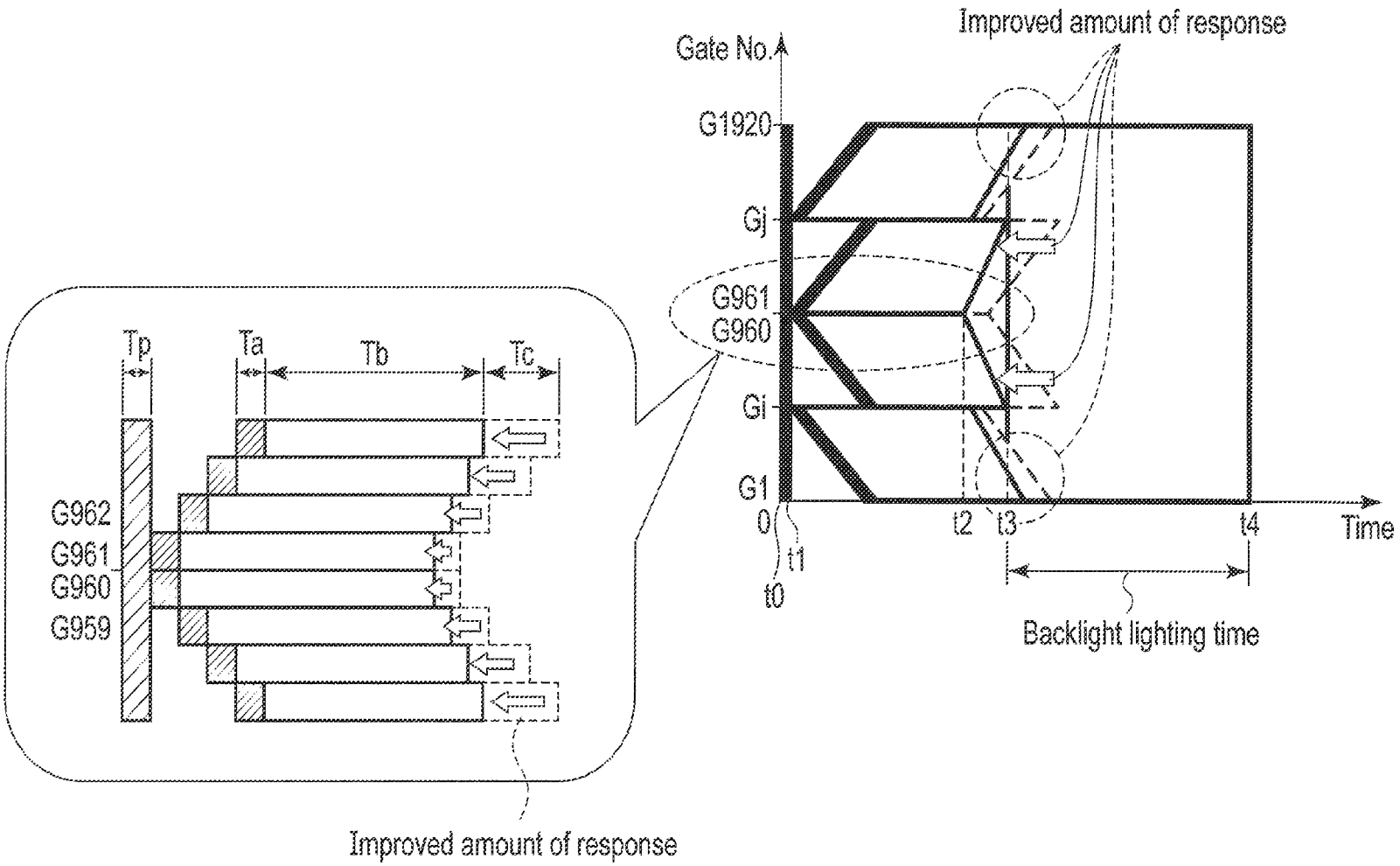
FIG. 10 is an exemplary view showing an example of the liquid crystal response of a display device of a third embodiment.

FIG. 10 is a view showing an example of the liquid crystal response of a display device DSP of the third embodiment.

The axis of ordinate of the coordinates shown in FIG. 10 indicates the number of rows of unit pixels PX in the display area DA. That is, the axis of ordinate indicates the numbers of the scanning lines G. The axis of abscissa of the coordinates shown in FIG. 10 indicates the time of one frame.

At time t0, an image signal of the intermediate gradation (=gradation 145) is set to all the signal lines S and, thereafter, gate signals of all the scanning lines G1 to G1920 are turned on. In the period Tp during which all the gate signals are kept on, write (preparatory write) of an image signal of the intermediate gradation is carried out. After an elapse of the period Tp, the gate signals of all the scanning lines G1 to G1920 are turned off.

In the third embodiment, the display area DA is divided into four areas in the vertical direction and, in all the divided areas, display operations are carried out simultaneously and concurrently (vertically tetramerous scan). Let the four scanning lines at the boundaries between the four divided areas be Gi, G960, G961, and Gj (j≥962). Here, it is assumed that the area (area surrounded by the scanning lines Gi to Gj) at the central part of the display area DA is an area facing the line of sight and having the highest probability of being visually confirmed.

At time t1, gate signals of the scanning lines Gi, G960, G961, and Gj are turned on. In the period Ta during which the gate signal are kept on, write of the image signal is carried out. At a point in time at which the period Ta is terminated, although the corresponding pixel electrode PE is set to a potential corresponding to the image signal, the liquid crystal has not yet completed the response. The period Tb from the time t1 to time t2 is a period (transition period) necessary for the liquid crystal to complete the response. At time t3, the backlight BLT starts lighting and, at time t4, the backlight BLT goes out.

The drive operation started from the scanning line G960 is carried out for G960, G959, • • • Gi+1 downwardly from the center of the screen. The drive operation started from the scanning line Gi is carried out for Gi, Gi−1, • • • G1 downwardly. The drive operation started from the scanning line G961 is carried out for G961, • • • Gj−1 upwardly from the center of the screen. The drive operation started from the scanning line Gj is carried out for Gj, Gj+1, Gj+2, • • • G1920 toward the upper part of the screen.

In each of the liquid crystals driven by the scanning lines Gi+1 to Gj−1 in the two central areas, the response time of the liquid crystal has become shorter by the preparatory write, and hence the response to the desired gradation is completed before the time t3 at which the backlight BLT goes on. Regarding the liquid crystals driven by the scanning lines G1 to Gi and scanning lines Gj to G1920 in the two areas on the upper end side and lower end side, the response to the desired gradation may not be completed before the time t3 at which the backlight BLT goes on. This is because the pixel areas on the upper end side and lower end side are at positions out of the center of the line of sight, and hence even when the response of the image at each end part delays, the delayed response is hardly confirmed visually.

Here, although the preparatory write has been carried out by taking all the pixels as the object, it is also possible to carry out preparatory write for only the liquid crystals driven by the scanning lines Gi+1 to Gj−1 in the two central areas, and not to carry out preparatory write for the liquid crystals driven by the scanning lines G1 to Gi and scanning lines Gj to G1920 in the two areas on the upper end side and lower end side. This is because the pixel areas on the upper end side and lower end side are at positions out of the center of the line of sight, and hence even when the response of the image at each end part delays without carrying out the preparatory write, the delayed response is hardly confirmed visually. Accordingly, it is possible to determine whether preparatory write is to be carried out by taking all the pixels as the object or preparatory write is to be carried out for only the liquid crystals in the two central areas by giving consideration to the hardware configuration and the like.

It should be noted that regarding the size of the central areas, it has already been confirmed as a result of a response test that the visibility is not impaired when the central areas include an area greater than or equal to 50% (desirably, greater than or equal to 70%) of the total display area.

According to the third embodiment, by combining the preparatory write and vertically tetramerous scan with each other, it is possible to increase the lighting time of the backlight BLT, and hence it is possible to reduce the power consumption. Further, it is possible to make the one frame period shorter than the first embodiment, and hence it is possible to enhance the response performance.

Next, an operation of the display device DSP configured to realize the above-mentioned function will be described below with reference to FIG. 1.

The preparatory write is identical to the first embodiment, and hence a description thereof is omitted. Further, the lighting operation of the backlight BLT is identical to the first embodiment, and hence a description thereof is omitted.

The third embodiment differs from the second embodiment in the point that the gate driver GD includes four circuits (not shown) each of which is configured to output a gate signal G to corresponding one of the four divided screens, and the source driver SD includes four types of source lines each of which is configured to output an image signal to a corresponding one of the four divided screens. It should be noted that the image display operation is identical to the second embodiment, and hence a description thereof is omitted.

Fourth Embodiment

A fourth embodiment differs from the first embodiment in the point that as a preliminary step of the preparatory write to all the pixels, a switch configured to short-circuit all the signal lines is provided. Parts identical to or similar to the first embodiment are denoted by reference symbols identical to the first embodiment, and their detailed descriptions are omitted.

Figure 11:
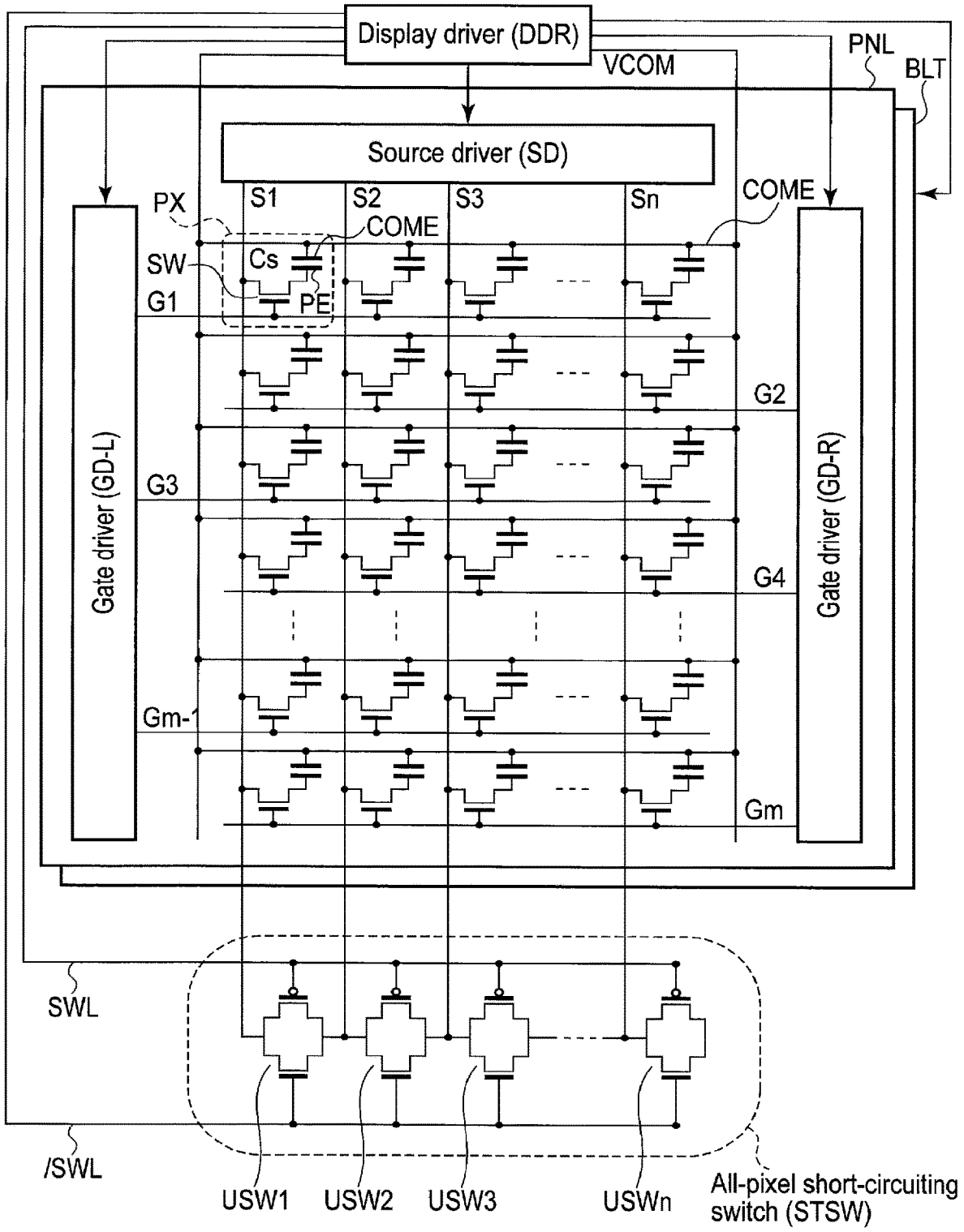
FIG. 11 is an exemplary view showing the schematic configuration of a display device of a fourth embodiment.

FIG. 11 is a view showing the schematic configuration of a display device DSP of the fourth embodiment.

In the fourth embodiment, an all-pixel short-circuiting switch STSW is provided. The all-pixel short-circuiting switch STSW operates according to a signal from the display driver DDR to short-circuit all the signal lines.

The all-pixel short-circuiting switch STSW has a configuration in which unit switches USWi (i=1 to n) provided for all the signal lines S are connected in series in the row direction identical to the arrangement direction of the unit pixels PX. The unit switch USW is constituted of a transfer gate formed by connecting an Nch transistor and Pch transistors in parallel. To an input terminal of a unit switch USWi (i=1 to n), a signal line Si (1=1 to n) is electrically connected, and an output terminal of the unit switch USWi is connected to an input terminal of a unit switch USWi+1 of the next stage. Further, to a gate of the Pch transistor, a switch line SWL is electrically connected, and to a gate of the Nch transistor, a switch line /SWL is electrically connected. Here, signals of the switch line SWL and switch line /SWL are signals 180° out of phase with each other.

Subsequently, an operation of the all-pixel short-circuiting switch STSW will be described below.

At a stage prior to carrying out preparatory write to all the pixels described above, the display driver DDR outputs signals configured to make the Pch transistor and Nch transistor of the transfer gate conductive to the switch line SWL and switch line /SWL, respectively. The transfer gate of the all-pixel short-circuiting switch STSW is made conductive, and all the signal lines S are electrically connected to each other.

As a result, the electric charge which has been retained on the signal lines S is equalized. When a display operation has been executed by inversion drive such as column-inversion drive, line-inversion drive or the like, the signal lines S are substantially reset to the common voltage by the equalization of the electric charge. Thereby, a phenomenon in which a sudden change is made from a voltage of a reverse polarity to a gradation voltage of preparatory write is eliminated, and hence it is possible to remarkably reduce the time necessary for preparatory write, and power consumption necessary for preparatory write.

Figure 12:
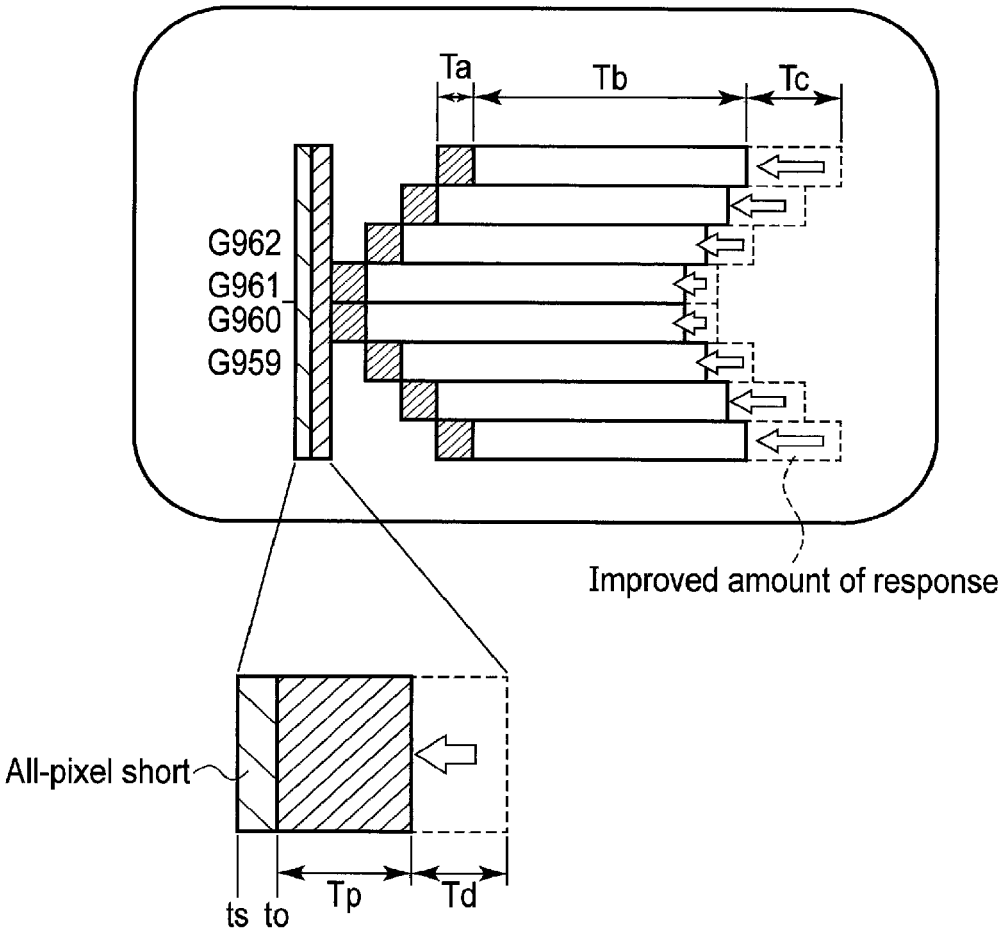
FIG. 12 is an exemplary view showing an example of the liquid crystal response of the display device of the fourth embodiment.

FIG. 12 is a view showing an example of the liquid crystal response of the display device DSP of the fourth embodiment. In FIG. 12, upper/lower dual-partitioning scan of the second embodiment is shown as an example.

At time ts, the all-pixel short-circuiting switch STSW operates. At time t0, preparatory write of the intermediate gradation is started. Owing to the short-circuiting operation of the signal lines S carried out by the all-pixel short-circuiting switch STSW, the preparatory write period Tp is made shorter than the case where the all-pixel short-circuiting switch STSW is not used by a period Td. As a result, each of the drive operations started from the scanning line G960 and scanning line G961 is made shorter by the period Td. Furthermore, even when the preparatory write period Tp is made shorter, the response improvement period Tc resulting from the preparatory write is not changed as before.

According to the fourth embodiment, the all-pixel short-circuiting switch STSW is operated as a stage prior to all-pixel preparatory write, whereby it is possible to further enhance the response performance in the first to third embodiments.

Method of Determining a Preparatory Write Voltage

Next, a method of obtaining the optimum gradation to be used for preparatory write when a relationship between the liquid crystal response and initial voltage shown in, for example, FIG. 4 or FIG. 8 is given will be described below.

Figure 13:
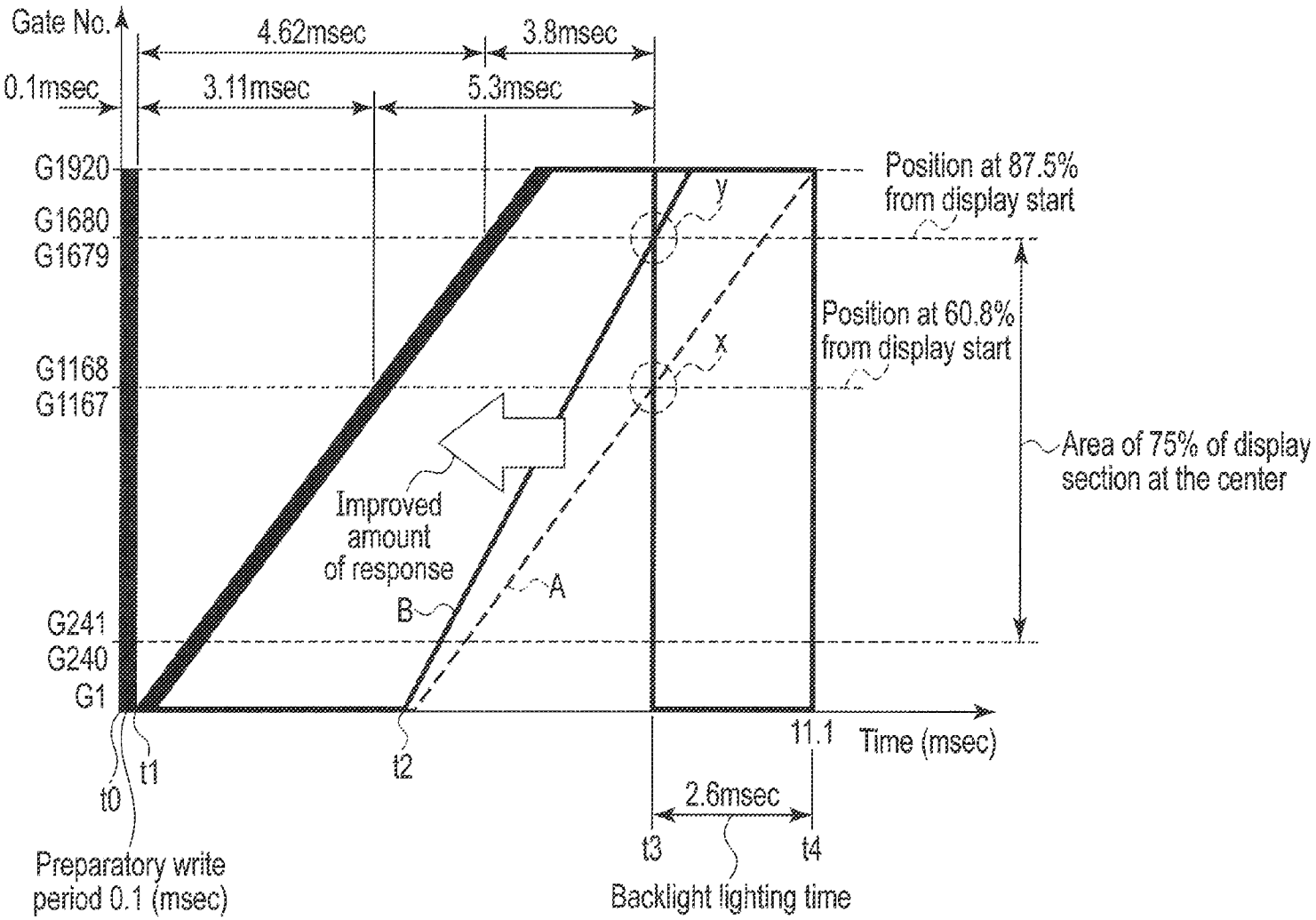
FIG. 13 is an exemplary view for explaining a method of selecting a preparatory write voltage of the display device of the embodiment.

FIG. 13 is a view for explaining a method of selecting a preparatory write voltage of the display device DSP of the embodiment. FIG. 14 is a view showing a relationship between the liquid crystal response and initial voltage to be used when the preparatory write voltage of the display device DSP of the embodiment is selected.

<A Case where Preparatory Write is not Carried Out>

The display device DSP taken as the object is a panel of which number of rows is 1920, and is driven at 90 Hz (one frame period: 11.11 ms). Let one horizontal (H) period be 2.75 μs, and let the backlight lighting time be 2.6 ms. As the display screen, a screen in a state where an object of intermediate gradations moves with black used as a background is assumed.

In FIG. 13, first, the scanning line G1 on the X-axis of the coordinates will be described below. At time t0, preparatory write is carried out and, thereafter, at time t1, the gate signal of the scanning line G1 is turned on, and write of an image signal is carried out. After the write of the image signal, between the time t1 and time t2, the liquid crystal completes the response. The response ending time of each of liquid crystals connected to the scanning lines G including the scanning line G2 and subsequent scanning lines is indicated by a point on the straight line A. At time t3, the backlight BLT starts lighting and, at time t4, the backlight BLT goes out. When a point of intersection of the straight line A with a straight line expressed by the time t3 and parallel to the Y-axis exists, the state where the liquid crystal is responding is visually confirmed.

From the relationship between the liquid crystal response and initial voltage shown in FIG. 14, assuming that the start gradation is 0, and the target attainment gradation is within the range from 45 to 207, the maximum value of the liquid crystal response time within this attainment gradation range is 5.3 ms. Then, in FIG. 13, let the display row corresponding to the point x at which the straight line A and the straight line expressed by the time t3 and parallel to the Y-axis intersect each other for the first time be the row X, thus the following formula is established in the case where preparatory write is not carried out.

$$2.75\ \mu s * \text{row } X + 5.3\ \text{ms} + 2.6\ \text{ms} = 11.11\ \text{ms}$$

From this formula, X≈1167.3 is obtained. This value corresponds to a position at 60.8% (=1167.3/1920) from the display start row.

Accordingly, when the preparatory write is not carried out, although in the area up to 60.8% of the screen, the response of the liquid crystal is completed, in the remaining area of 39.2%, the state where the liquid crystal is responding is visually confirmed. In order that 75% or more of the screen may complete the response, this being the target, it becomes necessary to carry out the preparatory write.

<A Case where Preparatory Write is Carried Out>

In the same manner as that described above, assuming that the target attainment gradation is within the range from 45 to 207, the start gradation enabling the liquid crystals to complete the responses in the area of 75% of the display area DA positioned at the center of the screen before the backlight BLT goes on is obtained. The row at the upper end of the area of 75% of the display area DA positioned at the center of the screen is the row 1680 (=1920*0.875) located at a position 87.5% (=75+25/2) from the scanning line G1. Let the point of intersection of the line expressing the row 1680 parallel to the X-axis with straight line expressing the time t3 parallel to the Y-axis be a point y. A straight line B connecting a point on the X-axis expressing the time t2 and the point y expresses the characteristic line of the improved liquid crystal response completion.

Considering the time necessary for each operation on the straight line passing through the point y parallel to the X-axis, the following formula is established.

$$\text{one frame period } (11.11\ \text{ms}) = \alpha + \beta + \gamma + \delta$$

α: preparatory write time (0.1 ms)

β: latency time elapsing before start of gate scan (2.75 μs*1680)

δ: time elapsing before liquid crystal response completion

γ: lighting time of backlight BLT (2.6 ms)

Substituting the values into the formula yields the following result.

δ: time elapsing before liquid crystal response completion=3.79 ms

When a start gradation making the target attainment gradation within a range from 45 to 207, and making the response time less than or equal to 3.8 ms is examined with reference to FIG. 14, gradations 118 and 145 are obtained. On the other hand, when the preparatory write is carried out, it becomes necessary that the liquid crystal response of the preparatory write should be completed before the start of the regular write. Accordingly, it is necessary that the response time from the start gradation 0 to the gradation of the preparatory write be less than or equal to α+β (=4.72 ms). Although the response time from the start gradation 0 to the target attainment gradation 118 is 4.7 ms satisfying the condition, the response time from the start gradation 0 to the target attainment gradation 145 is 5.3 ms not satisfying the condition. Accordingly, the start gradation for the preparatory write becomes 118.

<A Case where Black Display-Adaptable Preparatory Write is Carried Out>

The display device DSP taken as the object is a panel of which number of rows is 1920, and is driven at 90 Hz (one frame period: 11.11 ms). Let one horizontal (H) period be 2.75 μs, and let the backlight lighting time be 2.6 ms. As the display screen, a screen for full-screen black display is assumed.

There is sometimes a case where almost the entire surface of the display screen is of a single color (for example, black). For example, as the start screen, a screen almost all of which is of a single color of black, screen on which small characters are displayed in white only at the center of a black background or the like is used. On such a screen, even if a small part not having the desired gradation exists, the visibility is largely impaired. Regarding the aforementioned preparatory write voltage, selection attaching great importance to responsivity has been carried out, and hence there has also been a possibility of a part on the screen not having the desired gradation being present. In the following example, a method of setting a preparatory write gradation enhancing the responsivity and not impairing the visibility will be described.

Figure 15:
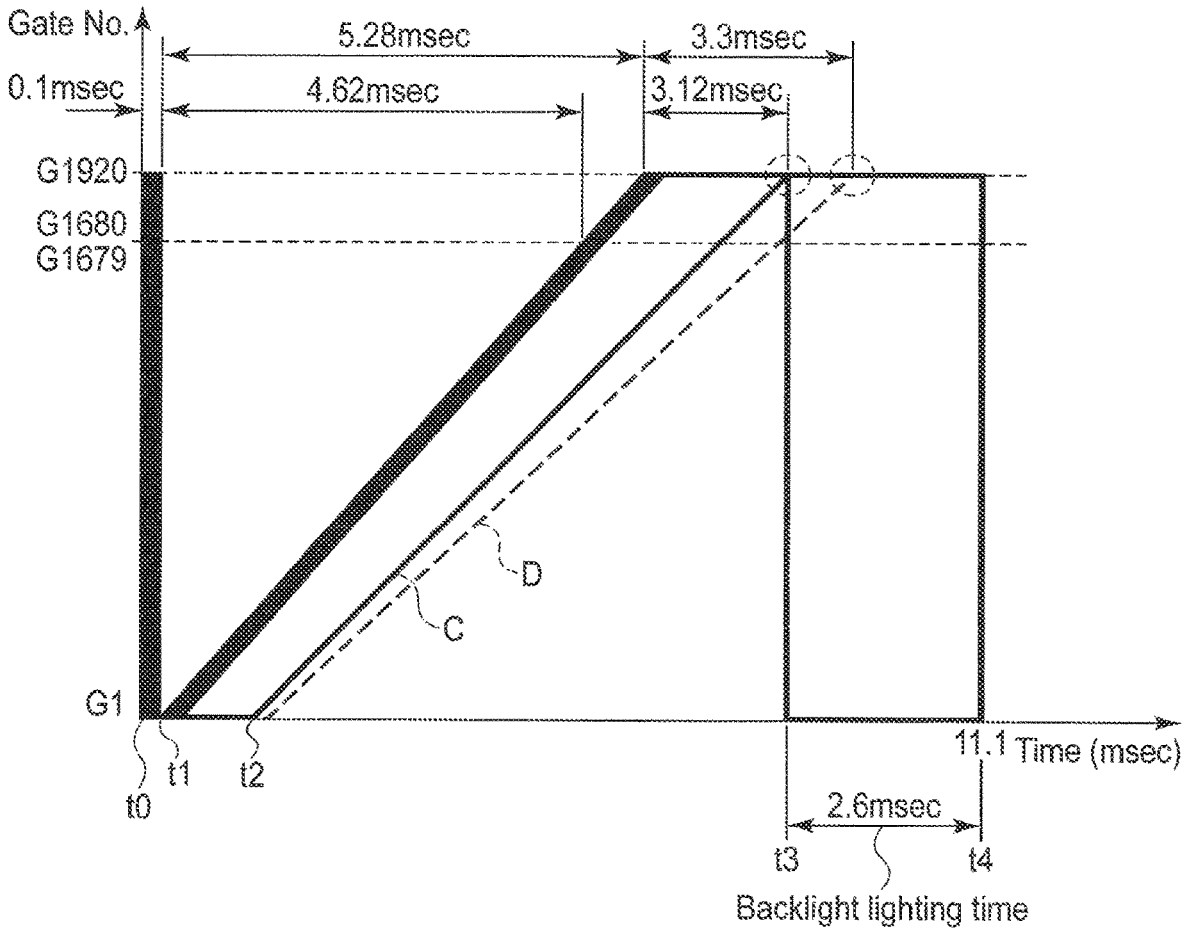
FIG. 15 is an exemplary view for explaining a method of selecting a preparatory write voltage not impairing the visibility of the display device of the embodiment.

FIG. 15 is a view for explaining a method of selecting a preparatory write voltage not impairing the visibility of the display device DSP of the embodiment.

FIG. 16 is a view showing a relationship between the liquid crystal response and initial voltage to be used when a preparatory write voltage not impairing the visibility of the display device DSP of the embodiment is selected.

In FIG. 15, first, the scanning line G1 on the X-axis of the coordinates will be described. In the initial state, the display screen is of full-screen black display. At time t0, preparatory write is carried out. The gradation written by the preparatory write is not black (0), and hence the screen becomes that of no black display. At time t1, the gate signal of the scanning line G1 is turned on, and write of an image signal of black (0) is carried out. After the write of the image signal, the liquid crystal completes the response between the time t1 and time t2.

The response completion time of the crystal associated with each of the scanning line G2 and subsequent scanning lines is expressed by, for example, a point on the straight line C or straight line D. Here, the image signal is of the black gradation (0), and hence the screen changes from black to gray to black. Incidentally, in an area on the screen in which the number of scanning lines is small, the state returns from a state where a change in liquid crystal alignment from black to gray resulting from the preparatory write is not so remarkable to a state of black again. Accordingly, in an area on the screen having a smaller number of scanning lines G, the liquid crystal response time becomes shorter.

At time t3, the backlight BLT starts lighting and, at time t4, the backlight BLT goes out. Accordingly, as indicated by a straight line D, when a point of intersection of the response completion line and line expressed by the time t3 parallel to the Y-axis exists, on the screen subsequent to the row concerned, a color (gray) other than black is displayed, and hence the screen becomes a screen not having uniform black display, thereby largely impairing the visibility.

The target attainment gradation is set to 0, and a start gradation for making the liquid crystal complete the response in the display area DA positioned at the scanning line G1920 before the backlight BLT goes on is obtained. Considering the time necessary for each operation on a straight line expressing the position of the scanning line G1920 parallel to the X-axis, the following formula is established.

$$\text{one frame period } (11.11\ \text{ms}) = \alpha + \beta + \gamma + \delta$$

α: preparatory write time (0.1 ms)

β: latency time elapsing before start of gate scan (2.75 μs*1920)

δ: time elapsing before liquid crystal response completion

γ: lighting time of backlight BLT (2.6 ms)

Substituting the values into the formula yields the following result.

δ: time elapsing before liquid crystal response completion=3.12 ms

When a start gradation making the target attainment gradation black (0), and making the response time less than or equal to 3.12 ms is examined with reference to FIG. 16, gradations 45 and 79 are obtained. Accordingly, by carrying out the preparatory write using a gradation less than or equal to the gradation 79, it is possible to obtain a screen excellent in visibility. The straight line C shown in FIG. 15 indicates the response of a case where the preparatory write is carried out by using the gradation 79, and straight line D indicates the response of a case where the preparatory write is carried out by using the gradation 118.

As described above, when the system in which preparatory write is carried out to drive the liquid crystal is employed, the preparatory write voltage is set by using a liquid crystal response table expressing the response time of the liquid crystal for each combination of the initial voltage (start gradation) and the attainment voltage (target gradation), whereby it is possible to enhance the response performance of liquid crystal display. Further, the liquid crystal response table is used to set the preparatory write voltage, whereby it is possible to obtain a (black) display screen excellent in response performance and visibility.

Based on the display device which has been described in the above-described embodiments, a person having ordinary skill in the art may achieve a display device with an arbitral design change; however, as long as they fall within the scope and spirit of the present invention, such a display device is encompassed by the scope of the present invention.

A skilled person would conceive various changes and modifications of the present invention within the scope of the technical concept of the invention, and naturally, such changes and modifications are encompassed by the scope of the present invention. For example, if a skilled person adds/deletes/alters a structural element or design to/from/in the above-described embodiments, or adds/deletes/alters a step or a condition to/from/in the above-described embodiment, as long as they fall within the scope and spirit of the present invention, such addition, deletion, and altercation are encompassed by the scope of the present invention.

Furthermore, any advantage and effect other than those described in the first embodiment which are obvious from the description of the specification or arbitrarily conceived by a skilled person are naturally considered achievable by the present invention.

Various inventions can be achieved by any suitable combination of a plurality of structural elements disclosed in the embodiments. For example, the some structural elements may be deleted from the whole structural elements indicated in the above-described embodiments. Furthermore, some structural elements of one embodiment may be combined with other structural elements of another embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display driver configured to control a display operation of an active-matrix display device, wherein the active-matrix display device includes:

a display area in which liquid crystal pixels are arranged in a matrix form, a plurality of scanning lines arranged along rows in which the liquid crystal pixels are arranged, a plurality of signal lines arranged along columns in which the liquid crystal pixels are arranged, a plurality of switching elements arranged in vicinities of positions at which the scanning lines and the signal lines intersect each other, and a backlight configured to illuminate the display area, the display driver:

controls a preparatory write of writing a signal of a predetermined gradation to the liquid crystal pixels, thereafter controls sequential write of an image signal to the liquid crystal pixels, at a time after an elapse of a predetermined time from the preparatory write, makes the backlight light up, and controls the sequential write of the image signal in both of two areas formed by dividing the display area into two upper and lower areas, from a central area to a peripheral area of the display area, simultaneously and concurrently, wherein in a first liquid crystal pixel in the central area of the display area to which the signal of the predetermined gradation has been written in the preparatory write, a change in gradation corresponding to the image signal is completed before the backlight lights up, the central area includes an area greater than or equal to 70% of the display area, the display driver turns on the backlight after an elapse of a predetermined time T from the write of the image signal to a second liquid crystal pixel in the peripheral area of the display area, and $T1 \leq T < T2$ holds where T1 is a transition period of the second liquid crystal pixel in the peripheral area, and T2 is a transition period of the first liquid crystal pixel in the central area.

2. The display driver according to claim 1, wherein a response time of a liquid crystal pixel for a change in gradation from the predetermined gradation to an intermediate gradation is less than a response time of a liquid crystal pixel for a change in gradation from a gradation 0 to the intermediate gradation.

3. The display driver according to claim 2, wherein the display driver controls an operation of short-circuiting all the signal lines configured to supply an image signal to the liquid crystal pixels prior to the preparatory write.

4. The display driver according to claim 2, wherein when a screen in which an entire surface is constituted of a gradation 0 is to be displayed, in a liquid crystal pixel to which a signal of the predetermined gradation has been written in the preparatory write, a change in gradation corresponding to the image signal is completed before the backlight lights up.

5. The display driver according to claim 2, wherein the display driver obtains a permissible time from image signal write to a liquid crystal pixel to completion of a liquid crystal response with respect to a predetermined row of the display area from a drive condition of the active-matrix display device, obtains a start gradation making the response time less than or equal to the permissible time based on data associated with the response time necessary for each start gradation to change to each attainment gradation with respect to the liquid crystal used in the liquid crystal pixel, and makes the obtained start gradation the predetermined gradation in the preparatory write.

6. The display driver according to claim 2, wherein when displaying a screen an entire surface of which is constituted of a gradation 0, the display driver obtains a permissible time from image signal write to a liquid crystal pixel to completion of a liquid crystal response with respect to a row to be lastly driven in the sequential write of the image signal from a drive condition of the active-matrix display device, obtains a start gradation making the response time less than or equal to the permissible time based on data associated with the response time necessary for each start gradation to change to each attainment gradation with respect to the liquid crystal used in the liquid crystal pixel, and makes the obtained start gradation the predetermined gradation in the preparatory write.

7. An active-matrix display device comprising:

a display area in which liquid crystal pixels are arranged in a matrix form;

a plurality of scanning lines arranged along rows in which the liquid crystal pixels are arranged;

a plurality of signal lines arranged along columns in which the liquid crystal pixels are arranged;

a plurality of switching elements arranged in vicinities of positions at which the scanning lines and the signal lines intersect each other;

a backlight configured to illuminate the display area; and a display driver configured to control a display operation on the display area, wherein the display driver:

controls a preparatory write of writing a signal of a predetermined gradation to the liquid crystal pixels, thereafter controls sequential write of an image signal to the liquid crystal pixels, at a time after an elapse of a predetermined time from the preparatory write, makes the backlight light up, and controls the sequential write of the image signal in both of two areas formed by dividing the display area into two upper and lower areas, from a central area to a peripheral area of the display area, simultaneously and concurrently, wherein in a first liquid crystal pixel in the central area of the display area to which a signal of the predetermined gradation has been written in the preparatory write, a change in gradation corresponding to the image signal is completed before the backlight lights up, the central area includes an area greater than or equal to 70% of the display area, the display driver turns on the backlight after an elapse of a predetermined time T from the write of the image signal to a second liquid crystal pixel in the peripheral area of the display area, and $T1 \leq T < T2$ holds where T1 is a transition period of the second liquid crystal pixel in the peripheral area, and T2 is a transition period of the first liquid crystal pixel in the central area.

8. The active-matrix display device according to claim 7, wherein a response time of a liquid crystal pixel for a change in gradation from the predetermined gradation to an intermediate gradation is less than a response time of a liquid crystal pixel for a change in gradation from a gradation 0 to the intermediate gradation.

9. The active-matrix display device according to claim 8, wherein the active-matrix display device controls an operation of short-circuiting all the signal lines configured to supply an image signal to the liquid crystal pixels prior to the preparatory write.

10. The active-matrix display device according to claim 8, wherein when a screen in which an entire surface is constituted of a gradation 0 is to be displayed, in a liquid crystal pixel to which a signal of the predetermined gradation has been written in the preparatory write, a change in gradation corresponding to the image signal is completed before the backlight lights up.

11. The active-matrix display device according to claim 8, wherein the display driver obtains a permissible time from image signal write to a liquid crystal pixel to completion of a liquid crystal response with respect to a predetermined row of the display area from a drive condition of the active-matrix display device, obtains a start gradation making the response time less than or equal to the permissible time based on data associated with the response time necessary for each start gradation to change to each attainment gradation with respect to the liquid crystal used in the liquid crystal pixel, and makes the obtained start gradation the predetermined gradation in the preparatory write.

12. The active-matrix display device according to claim 8, wherein when displaying a screen an entire surface of which is constituted of a gradation 0, the active-matrix display device obtains a permissible time from image signal write to a liquid crystal pixel to completion of a liquid crystal response with respect to a row to be lastly driven in the sequential write of the image signal from a drive condition of the active-matrix display device, obtains a start gradation making the response time less than or equal to the permissible time based on data associated with the response time necessary for each start gradation to change to each attainment gradation with respect to the liquid crystal used in the liquid crystal pixel, and makes the obtained start gradation the predetermined gradation in the preparatory write.

* * * * *